United States Patent [19]

Seifert et al.

[11] 4,204,515

[45] May 27, 1980

[54] APPARATUS FOR MACHINING WORKPIECES BY ABRASION

[75] Inventors: Dieter Seifert, Marktl; Dieter Regler, Burghausen; Volker Ofenmacher, Burghausen; Alfred Moritz, Burghausen; August Freudlsperger, Neuötting; Walter Berger, Simbach, all of Fed. Rep. of Germany

[73] Assignee: Wacker-Chemitronic Gesellschaft für Elektronik-Grundstoffe mbH, Burghausen, Fed. Rep. of Germany

[21] Appl. No.: 934,770

[22] Filed: Aug. 17, 1978

[30] Foreign Application Priority Data

Aug. 31, 1977 [DE] Fed. Rep. of Germany ..... 2739257

[51] Int. Cl.[2] ..... B28D 1/06

[52] U.S. Cl. ..... 125/16 R; 51/59 R

[58] Field of Search ..... 51/59 R, 58, 59 SS; 125/16 R, 16 L, 17, 19

[56] References Cited

U.S. PATENT DOCUMENTS

| | | | |
|---|---|---|---|
| 4,105,012 | 8/1978 | Hini | 125/16 R |

FOREIGN PATENT DOCUMENTS

| | | | |
|---|---|---|---|
| 899913 | 12/1953 | Fed. Rep. of Germany | 51/59 R |
| 1373374 | 4/1964 | France | 125/16 R |
| 529341 | 5/1955 | Italy | 51/59 R |
| 21605 | 7/1911 | Norway | 125/16 R |

*Primary Examiner*—Harold D. Whitehead

*Attorney, Agent, or Firm*—Allison C. Collard; Thomas M. Galgano

[57] ABSTRACT

Apparatus for machining workpieces by abrasion by means of an oscillating multiple-blade tool, which is moved across the workpiece. The moved masses define an oscillatory system, as a result of which the energy can be stored in the reversal ranges by a buffer system. This apparatus, especially when designed as a lap-cutting machine for cutting semiconductor rods, is preferably driven by the oscillation of the masses to be moved, and is driven in the resonance range. The tool carriages are buffer loaded at each end and are oscillated at or near the natural resonance frequency of the moving masses.

4 Claims, 1 Drawing Figure

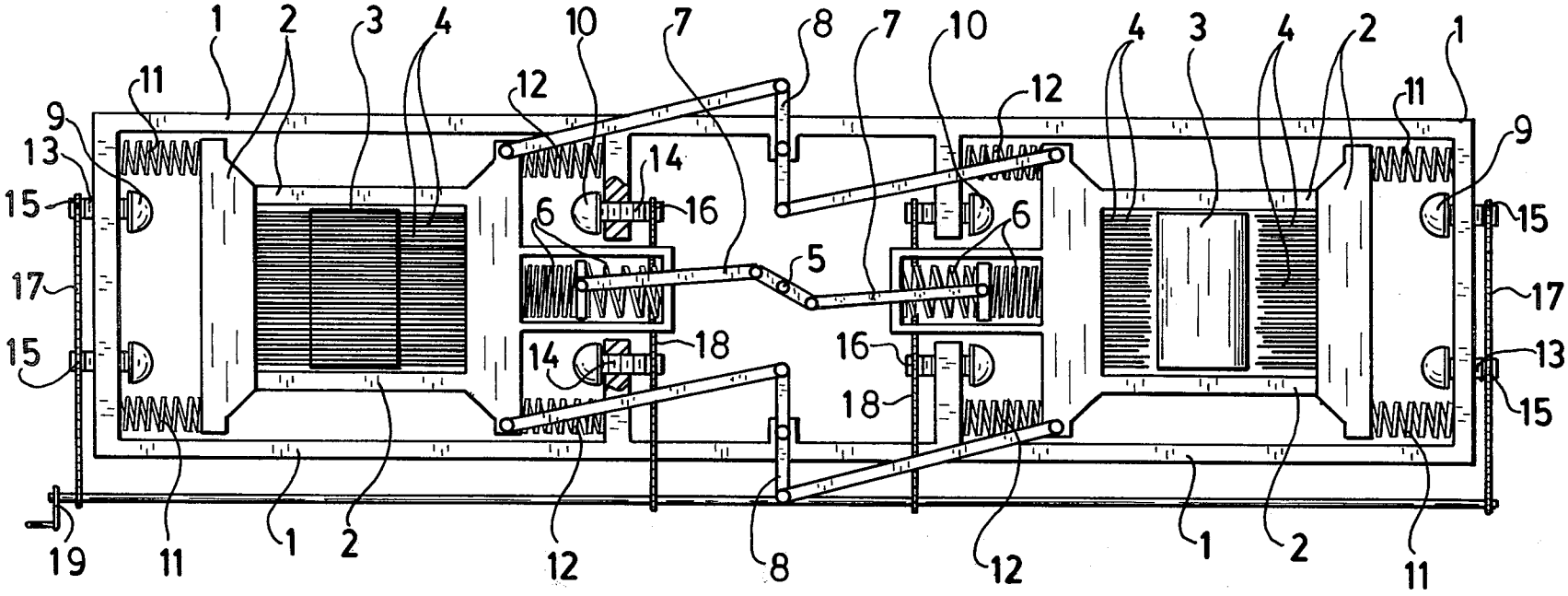
1
2
3
4
5
6
7
8
9
10
11
12
13
14
15
16
17
18
19

APPARATUS FOR MACHINING WORKPIECES BY ABRASION

The subject invention relates to an apparatus and for machining workpieces by abrasion by means of a multiple tool which oscillates across the workpiece.

Apparatus of this type, such as gang saws or lap cutting machines, are used for cutting oxidic substances, such as sapphire or ruby, and semiconductor materials, such as silicon or germanium. In the apparatus, a set of parallel steel blades separated from one another by spacers, is guided in an oscillatory movement across the workpiece to be cut, while carrying with it an abrasive, such as, for example, diamond powder, suspended in a coolant. A gang saw of this type is described, for example, in DE-PS 20 39 699.

The advantage of these saws and lap-cutting machines resides in the uniform surface damage of the face of the divided workpiece, so that the damaged layer can be removed subsequently by etching away a thin surface layer. Another advantage is that practically all discs are "bow-free", that is, uniformly flat with no bending. The disadvantage of these machines is that the movement necessary for cutting is effected by forcibly moved tool carriages. In the case of relatively large masses, that is, large saw frames with numerous blades and high relative speeds, enormous drive forces occur during acceleration and braking, which place a sharp limit on the maximum size of such frames and their weight; in addition, these machines are extremely energy-intensive. In order to rationalize the sawing of electronic base materials, however, a gang saw should be used, which allows the cutting of semiconductor rods of, for example, 1 m length, into approximately 1,000 or more small discs in one step. The problem underlying the invention was therefore to design machines that can be fitted with large frames and correspondingly large sets of blades.

This problem is solved by a corresponding device in which the masses to be moved are part of a vibratory system. It is particularly advantageous in the operation of this device, to allow the oscillation of the masses to be moved to occur in the resonance range, so that the natural frequency and operating frequency do not differ from each other by more than approximately 20%.

The invention is explained in detail with reference to the drawing which shows schematically, in a plan view, a gang saw or lap-cutting machine, according to the invention.

Referring to the FIGURE, there is shown a lap-cutting machine 1, with two tool carriages or frames 2, in which the sets of blades 4 necessary for machining the two workpieces 3, are clamped. The blades are mounted in suitable guides symmetrically with respect to the drive means. The guiding of the frames is effected in known manner, for example, by all guides, prism bearings, roller bearings, or air bearings. Saw frame 2 is driven by an indirect drive means, for example, an electric motor with flywheel, via the crankshaft 5 on presser bars 7, acting between the resilient elements 6, which are arranged in series with the frames 2 to be moved. Resilient elements 6 are, for example, coupling springs made of spring steel. It is possible to use instead of a motor with a flywheel for the indirect drive, conventional electromagnetic, pneumatic or hydraulic pulsator drives.

It is advantageous, by means of, for example, suitable rocker arms 8, to make sure a synchronous movement of the two saw frames 2 in opposite direction. By means of coupling springs 6, frames 2 are moved outwards under the abrasive action of blades 4 on workpieces 3, and are braked by outer buffers 9, having a non-linear characteristic, the energy for acceleration being for the most part accommodated by these buffers 9 on compression. Upon subsequent relaxation, this energy is released, accelerating saw frame 2 in the opposite direction. Frames 2 are slowed down again at the other end by corresponding buffers 10, and subsequently accelerated in the opposite direction. This braking and reacceleration is additionally promoted by springs 11 and 12, by means of which the saw frames are connected at all four corners to the framework of the machine. These additional springs can be dispensed with, however, in free-oscillation systems.

Suitable buffers 9 and 10, are springs having a progressive characteristic curve. Rubber buffers or conical springs are therefore advantageously used as favorable embodiments of these buffers 9 and 10. As a result of the progressive characteristic of the springs of the buffer system, a broader resonance range can be achieved, so that the oscillating amplitudes are substantially independent of the operating conditions.

Buffers 9 and 10 are preferably mounted on threaded mountings 13 and 14 respectively, so that they can be unscrewed via gearwheels 15 and 16 disposed at the end of these threaded mountings, via the chains 17 and 18 respectively with chain drive 19, in order to shorten the stroke. Shortening the stroke is necessary in lap-cutting machines due to the fact that the lapping abrasive, which is carried through the saw gap with the smooth, uncoated blades, causes not only abrasion of the workpiece, but also of the blade. Consequently, with the passage of time, edges are formed at the arrest points of the blade, which can lead to material breaking away in the workpiece being machined. For this reason, the stroke and thus the free active blade length must be shortened from time to time. In conventional lap-cutting machines with direct force transmission from the drive via the crankshaft to the tool carriages, the stroke can only be shortened when the machine is stationary. However, in accordance with the principle of the invention, the stroke adjustment can be effected during operation by a simple alteration of the spacing of buffers 9 and 10 effective at the ends of the stroke. The stroke end can be shortened very generally by damping elements, that is, by tuning the oscillating system.

The advantage of the apparatus according to the invention over conventional machines for machining workpieces by abrasion using a multiple tool is that, owing to the indirect drive, the force no longer acts directly on the saw frames, but only on the moved masses. The accelerating energy is not lost at the arrest points but is stored in the springs and reclaimed. The drive is therefore correspondingly easier to execute. As a result of separating the acceleration and retardation from the drive, these forces are taken away from the bearings, as a result of which the service life of the apparatus according to the invention, is increased considerably in comparison with conventional lap-cutting machines. In accordance with the invention, it is now possible to fit lap-cutting machines with large saw frames and correspondingly large moved masses. Moreover, these machines can now be operated at high speeds.

While only a single embodiment of the present invention has been shown and described, it will be obvious to those persons of ordinary skill in the art, that many changes and modifications may be made thereunto, without departing from the spirit and scope of the invention.

What is claimed is:

1. An apparatus for machining workpieces by abrasion by means of a multiple tool which oscillates across the workpiece, comprising:

a machine housing having at least a frame which has a pair of opposite sides defining at least one compartment;

tool carriage means disposed for movement within said compartment, said carriage means having a multitude of parallel, spaced-apart blades disposed across the workpiece;

at least one opposite pair of buffers for contact with said carriage means during movement, said buffers comprising a plurality of resilient storage springs having a progressive characteristic curve, said springs being mounted on threaded shafts coupled through the opposite sides of said frame, a gear mounted on each spring shaft, a chain coupled to each of said gears, and a common chain drive coupled to each chain for simultaneously adjusting all of said buffers, so as to control the oscillation of said carriage means; and drive means coupled to said carriage means for oscillating said carriage means between said buffers, wherein said drive means includes intermediary resilient coupling means for coupling said drive means to the tool carriage.

2. The apparatus as recited in claim 1 wherein the apparatus includes at least one pair of tool carriages coupled together in a way that they move synchronously in opposite direction.

3. The apparatus as recited in claim 2 wherein said drive means comprises a crankshaft, a pair of oppositely-directed presser bars joining the ends of said crankshaft to each of said carriage means, and a pair of rocker arms joining the adjacent ends of said carriage means.

4. The apparatus as recited in claim 1, wherein said buffers are so arranged within the apparatus that their positions in the direction of oscillation can be altered simultaneously while the tool is in operation.

* * * * *